US005280743A

United States Patent [19]

Abel et al.

[11] Patent Number: 5,280,743

[45] Date of Patent: Jan. 25, 1994

[54] APPARATUS AND METHODS OF MANUFACTURING LUMINOUS DRUMSTICKS

[75] Inventors: James T. Abel; Jeffrey T. Abel, both of Camarillo, Calif.

[73] Assignee: JTA Products, Camarillo, Calif.

[21] Appl. No.: 921,464

[22] Filed: Jul. 28, 1992

Related U.S. Application Data

[63] Continuation of Ser. No. 580,839, Sep. 11, 1990, abandoned.

[51] Int. Cl.[5] ..... G10D 13/02

[52] U.S. Cl. ..... 84/422.4; 362/102

[58] Field of Search ..... 84/422.1, 422.2, 422.3, 84/422.4; 362/34, 84, 102; D17/22, 23

[56] References Cited

U.S. PATENT DOCUMENTS

| | | | |
|---|---|---|---|
| 3,576,987 | 5/1971 | Voight et al. | 362/34 |
| 4,106,079 | 8/1978 | Drury | 84/422.4 X |
| 4,202,241 | 5/1980 | Lucas | 84/422.4 |
| 4,226,163 | 10/1980 | Welcomer | 84/422.4 |
| 4,722,035 | 1/1988 | Rapisarda | 84/422.4 X |
| 4,763,557 | 8/1988 | Donohoe | 84/422.4 |

*Primary Examiner*—Michael L. Gellner
*Assistant Examiner*—Howard B. Blankenship
*Attorney, Agent, or Firm*—Workman, Nydegger & Jensen

[57] ABSTRACT

The present invention is directed to luminous drumsticks. The drumsticks of the present invention permit the drummer to perform visually dramatic drumstick maneuvers and exhibitions without impeding the drummer's traditional responsibility of providing a continuum of timely rhythm to the subject music. This is achieved because the drumsticks embodying this invention comprise drumstick body elements which are configured such that the center of mass of the drumstick is at substantially the midpoint of the length of the drumstick body, and such that either end of the drumstick may function as the drum tip. The ends are also configured such that they are compatible for universal use on all types of percussion instruments. Such a construction of drumsticks permits the drummer to predictably and confidently manipulate the drumsticks for the desired visual, yet timely rhythmic affect. The present invention also contemplates a novel method of manufacturing the same.

20 Claims, 2 Drawing Sheets

APPARATUS AND METHODS OF MANUFACTURING LUMINOUS DRUMSTICKS

This application is a continuation of U.S. application Ser. No. 07/580,839, filed Sep. 11, 1990, for APPARATUS AND METHOD FOR MANUFACTURING LUMINOUS DRUMSTICKS, now abandoned.

BACKGROUND

1. The Field of the Invention

The present invention is directed to drumsticks and methods for making the same. In particular, the drumsticks of the present invention have a construction which permits the insertion of radiant or reflective light sources. Furthermore, drumsticks of the present invention are constructed so as to be substantially symmetric in mass and configuration, and having a simplified construction.

2. Description of the Currently Available Products

Currently available luminous or lighted drumsticks offer the drummer the advantage of being not only heard, but also seen. Such luminous drumsticks include drumsticks that require some power source combined with a light source. For example, some luminous drumsticks include an electrical lead extending from the end of the drumstick which supplies the necessary power or energy to a light source or diode within or attached to the drumstick. Such drumsticks proffer the drummer an electrical light source within the specially configured tip of the drumstick tethered to an electrical lead.

Other luminous drumsticks similarly comprise a specially configured electrical light diode in one tip of the drumstick, but draw upon electrical power from a source such as an internal battery housed in the other end of the drumstick shank. Such drumsticks require specialized electrical and structural construction to assure an electrical circuit including a power source, light emitting diode, and leads between the power source and the light emitting diode.

Still other luminous drumsticks comprise hollow shanks which may be colored or radiate by way of an insertable inner core, and further comprise particularly configured and structured handles and tips.

The currently available luminous drumsticks do not, however, serve the needs of the drummer who incorporates exhibition-type drumstick maneuvers into his performance and who wishes to be seen as well as heard. Drummers who play with bands remain, even today, largely relegated to establishing and maintaining the heart-beat of the band through the pervading cadence of the drum beat, but are typically only "heard and not seen." However, many drummers wish to be seen and to be part of a dramatic as well as audio contribution. Therefore, it is important for the drummer's movement to be not only visible, but unhindered or unimpeded. Luminous drumsticks, if properly configured, provide the drummer the capability of nearly unlimited range of movement and continuity during the drummer's exhibition and musical contribution.

When employing currently available luminous drumsticks, however, the drummer must either be tethered to a power source or be acutely aware of the orientation of the drumstick to assure that the specially designed and shaped tip of the drumstick is used to strike the percussion instrument, and is not being clasped in the palm of the drummer. As a result, the drummer is constrained to position, maintain, and assure that the drumstick is always held in his hand in a certain manner conducive to drumming. In other words, the currently available luminous drumsticks are designed and constructed to have a handle and a tip, serving mutually exclusive objectives and purposes. The handle portion of the currently available drumsticks serve to offer the drummer a suitable grip interface while also serving as the housing for the power source of some luminous drumsticks. The tip on the other hand, is designed to offer the drummer the optimum hammer effect upon the intended percussion instrument. Unfortunately, such configurations do not serve the needs of the drummer who for dramatic effect and/or audience appeal twirls or gyrates the drumstick.

Exhibition drumming is incorporated into the musical score or is extemporaneously interjected into the rhythm of the music in such a manner that maintaining the rhythm of the music and executing the exhibition maneuvers should be integrated functions. This requires the drummer to have the capability of being able to immediately make the transition from dazzling maneuvers to rhythmic drumming. This transition is shackled by the requisite handle-tip configurations and orientation of the currently available luminous drumsticks.

Similarly, some drummers also wish to toss the drumstick upward in a spinning or twirling fashion, yet need to be able to immediately continue playing upon the reclasping or catching of the drumsticks. Currently available drumsticks require the drummer to deliberately orient the drumstick in the requisite handle-tip attitude after every stunt before again striking the percussion instrument.

Furthermore, the currently available art does not generally lend itself to the acrobatic type exhibition drumming performed by concert drummers. The drummer's dramatic contribution to the musical presentation depends upon the ability of the drummer to confidently twirl, whirl, or toss the drumsticks without losing control of them or dropping them.

Preferably, the mass of the drumsticks should be proportionately distributed so as not to impede the physics of the desired twirl, whirl, or toss. For optimal execution of such exhibition drumming, the mass of the drumstick should not be asymmetrically distributed over the length of the drumstick. In other words, an imbalanced or disproportionate distribution of the mass of the drumstick does not permit the drummer to assuredly twirl, whirl, or spiningly toss the drumsticks or to predict the action or path of the drumsticks. Instead, the drumsticks should be properly balanced so the drummer does not lose control of the drumstick, or drop it.

Many of the currently available luminous drumsticks are imbalanced. For example, weighty battery units opposing light weight electrical leads and light emitting diodes results in the imbalance of the drumstick. Similarly, if the handle of the drumstick is significantly different in shape and mass from other aspects of the drumstick such as the tip, the ability of the drummer to manipulate the drumstick in a showy manner is impeded.

In addition, many of the currently available drumsticks call for the distinct configuration of drumstick tips or heads for mutually exclusive use in conjunction with different percussion instruments. This does not permit the drummer to readily and immediately shift from one percussion instrument to a stunt and then readily and immediately shift to a different percussion instrument, if desired. The currently available drumsticks are so designed to structurally withstand the physical effects of the prolonged pounding and hammering of the drumsticks on a variety of materials comprising the various percussion instruments.

Similarly, the currently available luminous drumsticks require highly complex electrical and/or specialized molding construction. As a result, the drumsticks are costly and difficult to fabricate and manufacture.

BRIEF SUMMARY AND OBJECTS OF THE INVENTION

The present invention seeks to resolve a number of the problems which have been experienced in the art, as identified above. More specifically, the apparatus of this invention constitutes an advancement in the art of luminous drumsticks, as evidenced by the following objects and advantages realized by the present invention over the currently available drumstick technology.

It is an objective of the present invention to provide a luminous drumstick whose use neither hinders nor impedes the range, continuity, or timeliness of movement or rhythm required during drumming and/or exhibition drumming.

An additional objective of the present invention is to provide a luminous drumstick which can be clasped with equal ease at either end permitting the immediate transition from exhibition maneuvers to actual percussion drumming without needing to ensure the proper handle-tip orientation of the drumstick.

It is also an objective of the present invention to provide a luminous drumstick whose structure substantially uniformly or symmetrically distributes the mass of the drumstick over the length of the drumstick such that the physics of twirling, whirling, or tossing the drumsticks are not so affected so as to result in substantially unpredictable action or flight of the drumstick.

A further objective of the present invention is to provide a luminous drumstick whose end configuration permits universal use on all percussion instruments traditionally employed by a drummer.

Another objective of the present invention is to provide a luminous drumstick whose entire length is illuminated at all times.

Yet another objective the present invention is to provide a luminous drumstick whose visual effect is equally dramatic regardless of which end of the drumstick is actually clasped by the drummer.

Still an additional objective of the present invention is to provide a luminous drumstick whose construction and manufacture is significantly simplified for ease of construction and manufacture from readily available materials without the need of complex electrical or structural design, manufacture or molding.

The present invention is directed to drumsticks. More particularly, the drumsticks of the present invention have an elongated transparent body member having a bore therein, which bore may contain an insertable light-emitting or light-reflecting core. In addition, the drumsticks of the present invention are configured such that the two ends are uniformly sized and/or shaped with tips universally applicable to all percussion instruments. Furthermore, the mass of the drumsticks of the present invention is substantially uniformly and equally distributed over the length of the drumstick, or, its center of mass is located at substantially the midpoint of the length of the drumstick, to provide a symmetrically shaped or balanced drumstick. A preferred embodiment employs a body member having a substantially uniform cross-section along its entire length.

Briefly summarized, the drumsticks of the present invention comprise an elongated generally transparent body member having a first rounded end and a second rounded end at terminal portions. The body member is generally tubular in configuration defining a bore therein. A preferred embodiment of the tubular structure of the body member has a substantially uniform radial cross-section along its length. The body member terminates at its extremities with the rounded ends. The body member and the ends may be configured to have similar or substantially similar radial or longitudinal cross-section or configuration resulting in a drumstick whose mass is centered substantially about the midpoint of the length of the drumstick. On the other hand, it is conceivable that the body portion may have a different radial cross-section at the terminal end portions.

The rounded ends include the bore or an aperture through which the bore space may be accessed through the first or second rounded end. A luminous light source is inserted into the bore of the body member. The light source is positioned and retained in stationary position in the bore by recessed plugs inserted within the bore at or near both terminal ends of the body member.

BRIEF DESCRIPTION OF THE DRAWINGS

In order that the manner in which the above-recited invention and other advantages and objects of the invention are obtained, a more particular description of the invention briefly described above will be rendered below by reference to a specific embodiment and the presently understood best mode thereof which is illustrated in the appended drawings. Understanding that these drawings depict only the presently preferred embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
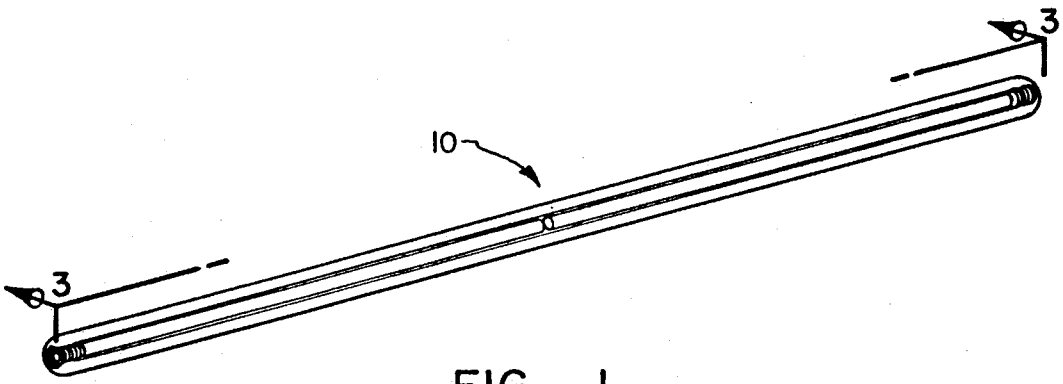
FIG. 1 is a perspective view of the drumstick containing a light-emitting core member.

FIG. 1 represents a perspective view of an embodiment of a luminous drumstick 10 embodying the teachings of the present invention. As shown, the drumstick is substantially symmetric in configuration about the midpoint of the drumstick.

Figure 2:
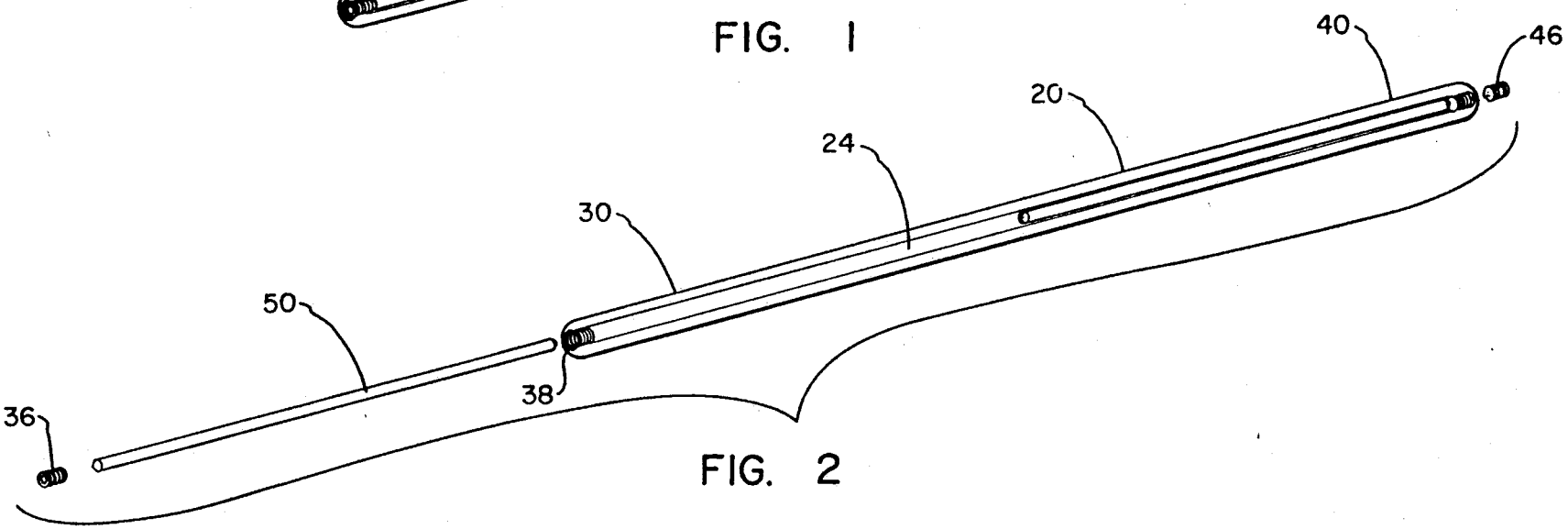
FIG. 2 is an exploded view of the drumstick shown in FIG. 1.
Figure 3:
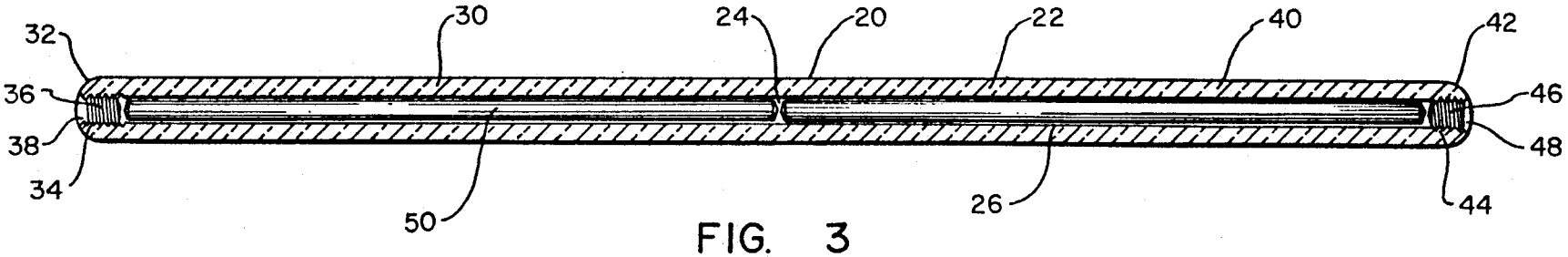
FIG. 3 is a longitudinal cross-sectional view of the drumstick taken along line 3—3 in FIG. 1.

As depicted in FIGS. 2 and 3, drumstick 10 comprises an elongate body member 20 having a first portion 30 and a second portion 40. Body member 20 comprises portions 30 and 40 and is a substantially transparent or translucent wall member 22 defining a bore 24. Body member 20 terminates at the extremity or terminal end of first portion 30 at first terminal end 32. Similarly, body member 20 terminates at the extremity or terminal end of the second portion 40 at second terminal end 42. As a result, bore 24 defines aperture 38 at first terminal end 32 and also defines aperture 48 at second terminal end 42.

As shown in FIG. 3, body member 20 comprises wall member 22 whose configuration results in a substantially uniform longitudinal and radial cross-sectional construction of wall member 22 along the length of body member 20. In other words, the radial cross-section of wall member 22, whether taken at some point in portion 30 or at some point in portion 40, is substantially similar along the length of body member 20. As a result, portion 30 and portion 40 have substantially similar or symmetric configurations.

Figure 4A:
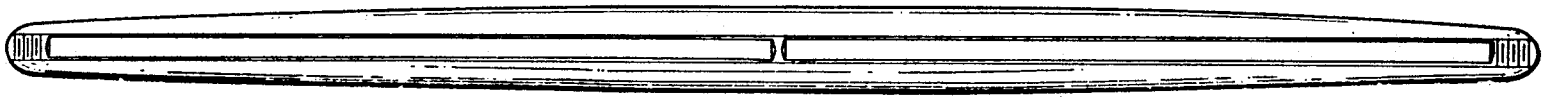
FIGS. 4A and 4B represented possible alternative embodiments of drumsticks having a centered or balanced mass.
Figure 4B:
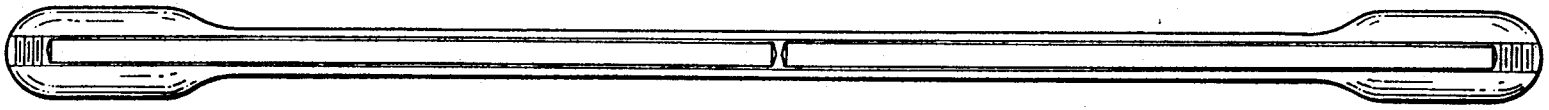

In an alternative embodiment, FIGS. 4A and 4B, the radial cross-section of wall member 22 may vary along the length of body member 20, while the mass of the body member remains symmetric about the midpoint of the length of body member 20. In either case, the actual longitudinal and radial cross-section of the wall member 22 at any given point is not a limiting factor so long as the net result is a balanced distribution of mass about a point which is substantially at the midpoint of the length of body member 20. In other words, so long as portion 30 and portion 40 have a center of mass at substantially the midpoint of the length of body member 20, the desired result is achieved.

Because the center of mass of the luminous drumsticks of the present invention resides at substantially the midpoint of the length of the drumstick and because the drumstick is not tethered to a power source, the drummer may, as was heretofore not contemplated, perform dramatic drumstick maneuvers and manipulation such as tosses, finger twirls, and other moves with nearly absolutely reliable and predictable confidence and precision without fearing erratic movement or shifting of the position of the drumstick which would result in dropping or losing control of the drumstick.

Body member 20 is constructed of impact resistant or durable material. Any hard, substantially transparent or translucent material is adequate. Practice of the present invention has revealed that polycarbonates such as Lexan® are the preferred material for body member 20.

Portion 30 comprises a portion of the length of body member 20 and terminal end 32. As shown in the FIGS. 1-3, terminal end 32 is rounded. Terminal end 32 may also be any configuration easily manufactured and compatible with the intended percussion instrument(s). Similarly, portion 40 comprises a portion of the length of body member 20 and terminal end 42. As shown in the FIGS. 1-3, terminal end 42 is rounded. As with terminal end 32, terminal end 42 may also be any configuration compatible with the intended percussion instrument(s). In a preferred embodiment, portion 30 and portion 40 are intended to be the mirror-image of each other about the midpoint of body 20. However, subject to the net result of having the center of mass of the drumstick located at substantially the midpoint of the length of body member 20, and the ability of the drummer to employ either end as the drumstick tip, the configurations of portion 30 and portion 40 may vary, as shown in FIGS. 4A and 4B.

In other words, distinct from currently available luminous drumsticks, the operation and function of terminal ends 32 and 42 are not mutually exclusive. To the contrary, portion 30 and portion 40 each operate as a handle and a tip. As a result, the drummer may employ either end of the drumstick subsequent to tossing or twirling drumstick 10 of the present invention. This permits the drummer to maintain the cadence or other necessary and timely rhythm of the music while offering the drummer-exhibitionist freedom and continuity of movement requisite to such drumming. This is accomplished because subsequent to a drumstick stunt, the drummer will always be able to immediately employ against the intended percussion instrument the end of the drumstick not clasped. As a result, the drummer may concentrate on stunts and rhythm without worrying about relative orientation of the drumstick itself.

Bore 24 is accessible through apertures 38 and 48. Core element 50 may be inserted into bore 24 through either aperture 38 or aperture 48. Core element 50 may be a light-emitting or light-reflecting source. Core element 50 may comprise a plurality of core subelements as shown in the drawings, or may comprise a single core element. In either case, core element 50 is positioned and retained in bore 24 by plug 36 and plug 46 such that the combined center of mass of body member 20, of core element 50, and of plugs 36 and 46 remains located at substantially the midpoint of the length of body member 20.

It is also conceivable that drumstick 10 comprises just one aperture. This, however, does not lend to installing and removing core 50. In the preferred embodiment two apertures offer advantages of ease of installing and removing core 50 because it is optimal to have core 50 only slightly smaller in cross-section than bore 24 so that core 50 is not freely moving about in a radial direction within core 24. As a result, having two apertures in body 20 is desireable to push core element in and out of body 20.

In the preferred embodiment of the present invention, core member 50 comprises a light-emitting or light-reflecting element. Similarly, core member 50 may comprise any colored or textured element. The present invention also contemplates merely lining or otherwise coloring interior surface 26 to achieve the desired radiant effect. As a result, body member 20 permits the transmission of light or reflection from core 50 along the entire length of the drumstick.

While not preferred or shown, it is also contemplated that body member 20 be sufficiently opaque or non-transparent, yet having openings or conduits permitting the transmission or passage of light to achieve a similar luminous affect.

Plugs 36 and 46 may be of any configuration or operation so long as they are readily removable as desired. Surface 34 and surface 44 of bore 24 is adapted with means for removably coupling plugs 36 and 46 within wall member 24. In the preferred embodiment, plugs 36 and 46 comprise set screws, and the removable coupling means comprises conventional threads adapted in surfaces 34 and 44 and compatible with threads adapted on the mating surface of plugs 36 and 46, respectively.

The configuration of terminal end 32 and terminal end 42 are universally adaptable to all forms of percussion instruments. Because terminal end 32 and terminal end 42 are rounded, there is no appreciable danger of damaging the impact surface of any percussion instrument whose construction material is softer than that construction material of the body member 20 such as the head of a drum. The favorable rounded and/or smooth construction or configuration of terminal end 32 and terminal end 42 are not adversely affected by plugs 36 and 46 because plugs 36 and 46, when properly positioned, are entirely recessed below the contact surface of ends 32 and 42. As a result, the drummer may use either end of the drumstick against any percussion instrument. Heretofore, certain drumstick tip configurations were pointed and were harmful when used against various instruments. The end or tip configuration of the present invention overcomes that difficulty. As a result, the entire length of the drumstick is always illuminated to assist the drummer in his/her dramatic contribution to the musical performance in conjunction with any percussion instruments.

The present invention also comprises methods of manufacture that offer advantages heretofore unknown in the prior art. Although there are many methods of manufacture for drumsticks, the method preferred in the present invention is novel in its simplicity and efficiency. The drumsticks are constructed by this method without the complex manufacture required by the currently available drumsticks.

In one preferred method, the steps of manufacture are few and simple. The first step comprises obtaining a substantially rodlike structure of a hard, transparent or translucent material, having a bore such that the rodlike structure is tubular. The next step comprises cutting the structure to a desirable length. Thereafter, the terminal ends are rounded in a substantially similar fashion. The terminal portion of the bore is then adapted to receive a plug means. In a preferred embodiment, conventional threads are adapted into body member 20 at surfaces 34 and 44 to be compatible with set screw 36 or 46. With at least one set screw removed, a light-emitting or light-reflecting core element may be inserted into the bore of the structure. The absent set screw is replaced closing off the open end of the bore. An alternative to the step of inserting a light-emitting core element is to simply color or line the interior surface.

Obtaining a rodlike structure having a bore therein may be accomplished in a number of ways. In the preferred embodiment, the rodlike structure having a bore is so extruded, requiring the drumstick to be merely cut to length and further adapted as described above. Another alternative means would be to have a solid rodlike structure cored or barreled. Still another alternative means of obtaining a rodlike structure as desired with a bore would be by conventional molding, molding the rodlike structure to the desired configuration.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drumstick comprising an elongate body member having a first portion and a second portion wherein the center of mass of the body member is located at substantially the midpoint of the length of the body member, wherein the body member further comprises means for transmitting or permitting the passage of light, the body member having a substantially tubular wall construction defining a bore therein, wherein the wall construction of the first portion and the wall construction of the second portion have respective terminal ends which ends are rounded, the bore traversing the entire length of the wall construction from one rounded end to the other rounded end such that the bore may be accessed through the rounded terminal ends of the wall construction, and wherein the bore is occluded by removable recessed plugs within the bore near the terminal ends of the wall construction such that no part of the plugs extend beyond the terminal ends of the wall construction, and wherein the rounded ends of the wall construction serve as the contact surface with the intended instrument.

2. A drumstick as defined in claim 1 wherein a core element is removably disposed within the bore.

3. A drumstick as defined in claim 2 wherein the core element reflects or emits light.

4. A drumstick as defined in claim 3 wherein the core element is retained within the bore of the body member by the removable recessed plugs.

5. A drumstick as defined in claim 4 wherein each removable recessed plug comprises a set screw.

6. A drumstick as defined in claim 3 wherein the terminal ends of the first portion and second portion are configured for universal use on all percussion instruments.

7. A drumstick as defined in claim 6 wherein the configuration of the terminal ends is rounded.

8. A drumstick as defined in claim 3 wherein the first portion and the second portion have a substantially similar configuration.

9. A drumstick as defined in claim 3 wherein the body member has a substantially uniform radial cross-section along the length of the body member.

10. A drumstick comprising an elongate body member wherein the body member has a substantially uniform radial cross-section along its length, wherein the body member further comprises means for transmitting or permitting the passage of light, the body member having a substantially tubular wall construction defining a bore therein, wherein the wall construction of the first portion and the wall construction of the second portion have respective terminal ends which ends are rounded, the bore traversing the entire length of the wall construction from one rounded end to the other rounded end such that the bore may be accessed through the rounded terminal ends of the wall construction, and wherein the bore is occluded by removable recessed plugs within the bore near the terminal ends of the wall construction such that no part of the plugs extend beyond the terminal ends of the wall construction, and wherein the rounded ends of the wall construction serve as the contact surface with the intended instrument.

11. A drumstick as defined in claim 10 wherein the center of mass of the body member is located at substantially the midpoint of the length of the body member.

12. A drumstick as defined in claim 11 wherein a core element is removably disposed within the bore.

13. A drumstick as defined in claim 12 wherein the core element reflects or emits light.

14. A drumstick as defined in claim 13 wherein the core element is retained within the bore of the body member by the removable recessed plugs.

15. A drumstick as defined in claim 14 wherein each removable recessed plug comprises a set screw.

16. A device for manual maneuvering to provide a stunning visual effect comprising an elongate body member having a first portion and a second portion wherein the center of mass of the body member is located at substantially the midpoint of the length of the body member, wherein the body member further comprises means for transmitting or permitting the passage of light, the body member having a substantially tubular wall construction defining a bore therein, wherein the wall construction of the first portion and the wall construction of the second portion have respective terminal ends which ends are rounded, the bore traversing the entire length of the wall construction from one rounded end to the other rounded end such that the bore may be accessed through the rounded terminal ends of the wall construction, and wherein the bore is occluded by removable recessed plugs within the bore near the terminal ends of the wall construction such that no part of the plugs extend beyond the terminal ends of the wall construction, and wherein the rounded ends of the wall construction serve as the contact surface with the intended instrument.

17. A device for manual maneuvering to provide a stunning visual effedt as defined in claim 16 wherein a core element is removably disposed within the bore.

18. A device for manual maneuvering to provide a stunning visual effect as defined in claim 16 wherein the core element reflects or emits light.

19. A device for manual maneuvering to provide a stunning visual effect as defined in claim 18 wherein the core element is retained within the bore of the body member by the removable recessed plugs removably coupled within the bore.

20. A device for manual maneuvering to provide a stunning visual effect as defined in claim 19 wherein each removable recessed plug comprises a set screw.

* * * * *